United States Patent [19]

Ishikawa et al.

[11] Patent Number: 4,543,322

[45] Date of Patent: Sep. 24, 1985

[54] PROCESS FOR THE PROCESSING OF COLOR PHOTOGRAPHIC SILVER HALIDE LIGHT-SENSITIVE MATERIAL

[75] Inventors: Takatoshi Ishikawa; Junya Nakajima, both of Kanagawa, Japan

[73] Assignee: Fuji Photo Film Co., Ltd., Kanagawa, Japan

[21] Appl. No.: 595,186

[22] Filed: Mar. 30, 1984

[30] Foreign Application Priority Data

Mar. 31, 1983 [JP] Japan ..... 58-55697

[51] Int. Cl.[4] ..... G03C 5/30; G03C 7/16; G03C 7/30

[52] U.S. Cl. ..... 430/380; 430/467; 430/468; 430/484; 430/490

[58] Field of Search ..... 430/478–479, 430/467–476, 484, 486, 485, 380, 490

[56] References Cited

U.S. PATENT DOCUMENTS

| | | | |
|---|---|---|---|
| 2,156,626 | 5/1939 | Ham | 430/466 |
| 2,444,803 | 7/1948 | Bean | 430/465 |
| 2,728,660 | 12/1955 | Saliminen et al. | 430/552 |
| 3,520,690 | 7/1970 | Nagae et al. | 430/470 |
| 3,617,273 | 11/1971 | Arai et al. | 430/473 |

OTHER PUBLICATIONS

Microfilm, vol. I, Jul. 1937, p. 12, "Fine Grain Furor".

*Primary Examiner*—Mary F. Downey
*Attorney, Agent, or Firm*—Sughrue, Mion, Zinn, Macpeak & Seas

[57] ABSTRACT

A process for processing a color photographic silver halide light-sensitive material comprising processing the color photographic silver halide light-sensitive material with a color developer containing at least one compound represented by the general formula (I):

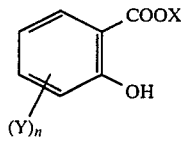

(I)

wherein X is a hydrogen atom, an alkali metal atom, an ammonium group, an alkyl group, or an aryl group; Y is a substituent on the phenyl group and is a halogen atom, an alkyl group, an alkoxy group, an amino group, a hydroxyl group, a nitro group, a sulfonic acid group or a carboxylic acid group; and n is 0, 1, 2, 3 or 4. Color developers containing the compounds of the general formula (I) have greatly increased stability and thus even after long-term storage, can be used to produce developed materials having superior photographic properties.

20 Claims, No Drawings

PROCESS FOR THE PROCESSING OF COLOR PHOTOGRAPHIC SILVER HALIDE LIGHT-SENSITIVE MATERIAL

FIELD OF THE INVENTION

The present invention relates to a process for the processing of a color photographic silver halide light-sensitive material. More particularly, it is concerned with a process for processing a color photographic silver halide light-sensitive material using color developers which have greatly increased stability.

BACKGROUND OF THE INVENTION

Color developers for use in the processing of color photographic silver halide light-sensitive materials (hereinafter sometimes referred to merely as "light-sensitive material") greatly influence the photographic characteristics.

In general, color developers contain an aromatic primary amine developing agent which forms dye on coupling with a coupler. These developing agents, however, are oxidized with a lapse of time by oxygen in the air or metal ions in the color developers. This adversely influences the photograhic characteristics. For this reason, as is well known, sulfites are used as antioxidants for color developing agents. The amount of these sulfites which can be used is limited since they seriously inhibit the coupling reaction between the developing agents and the couplers. Hence, in color developers, sulfites are not used in large amounts as they are in black and white developers.

U.S. Pat. No. 3,141,771 discloses that hydroxylamines can be used as antioxidants in combination with sulfites. The decomposition of these hydroxylamines, however, tends to be accelerated by the presence of heavy metal ions, such as iron ions and copper ions, yielding ammonia. As is well known, ammonia adversely influences the characteristics of color photographs. Thus, even if hydroxylamines are used, the stability of color developers are improved only insufficiently.

Various compounds have heretofore been proposed to prevent the decomposition of the color developing agents and hydroxylamines in the color developers. Typical examples are shown below.

Hydroxamic acid (U.S. Pat. No. 4,055,426); dihydroxynaphthalene compounds (Japanese Patent Application (OPI) No. 49828/77 (the term "OPI" as used herein means a "published unexamined Japanese patent application)); saccharides (U.S. Pat. No. 4,124,391); alkanolamines (U.S. Pat. No. 4,170,478); polyalkyleneimines (U.S. Pat. No. 4,252,892); α-aminocarbonyl compounds (U.S. Pat. Nos. 4,155,764 and 4,142,895); gluconic acids (Japanese Patent Application (OPI) Nos. 75647/81 and 41448/80); hydroxyacetone and dihydroxyacetone (U.S. Pat. No. 3,615,503 and British Pat. No. 1,306,176); 2-anilinoethanol (U.S. Pat. No. 3,823,017); and aromatic polyhydroxy compounds (Japanese Patent Application (OPI) Nos. 47038/81 and 32140/81, and U.S. Pat. No. 3,746,544).

These compounds, however, have disadvantages in that the stability of the color developers can be improved only insufficiently, they are expensive, the amount to be added should be increased, and the compounds themselves adversely influence the photographic characteristics. Hence they are not suitable for practical use.

SUMMARY OF THE INVENTION

An object of the invention is to provide a color developer which has greatly increased stability.

Another object of the invention is to provide a process for processing a color photographic silver halide light-sensitive material using a color developer which has greatly reduced variations in properties with the lapse of time.

The present invention provides a process for the processing of a color photographic silver halide light-sensitive material which comprises treating the light-sensitive material with a color developer containing at least one compound represented by the general formula (I):

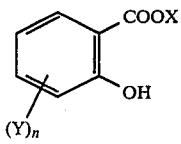

(I)

wherein X is a hydrogen atom, an alkali metal atom, an ammonium group, an alkyl group, or an aryl group. Y is a substituent on the phenyl group and is a halogen atom, an alkyl group, an alkoxy group, an amino group, a hydroxy group, a nitro group, a sulfonic acid group, or a carboxylic acid group, and n is 0 or an integer of 1 to 4.

DETAILED DESCRIPTION OF THE INVENTION

The compounds of the general formula (I) are described below in greater detail.

In the general formula (I), X is a hydrogen atom, an alkali metal atom, an ammonium group, an alkyl group, or an aryl group. Suitable alkali metal atoms include sodium, potassium and lithium. Exemplary alkyl groups can have from 1 to 10 carbon atoms and preferably from 1 to 5 carbon atoms, such as, a methyl group, an ethyl group, a propyl group, a butyl group, a hydroxyethyl group, etc. Suitable aryl groups have from 6 to 12 carbon atoms and include a phenyl group, a naphthyl group, etc., and is preferably a phenyl group. The alkyl and aryl groups may be substituted. Typical substituents which can be present are a halogen atom (e.g., a chlorine atom and a bromine atom), a hydroxy group, an alkyoxy group having from 1 to 4 carbon atom (e.g., a methoxy group, an ethoxy group, etc.), a sulfonic acid group, a carboxylic acid group, an aldehyde group, a nitro group, and an amino group.

Y is a substituent on the phenyl group and can be a halogen atom, an alkyl group, an alkoxy group, an amino group, a hydroxy group, a nitro group, a sulfonic acid group, or a carboxylic acid group. Examples of halogen atoms include a fluorine atom, a bromine atom, a chlorine atom, and an iodine atom. The alkyl and alkoxy groups can each have from 1 to 10 carbon atoms and preferably from 1 to 5 carbon atoms (e.g., alkyls such as a methyl group, an ethyl group, a propyl group, a butyl group, etc., and alkoxy groups such as a methoxy group, an ethoxy group, etc.). The alkyl and alkoxy groups may be substituted. Typical substituents which can be present include a halogen atom, a hydroxy group, a sulfonic acid group, and a carboxylic acid group. The amino group may also be substituted by a lower alkyl group such as a methyl group, an ethyl group, etc. The sulfonic acid and carboxylic acid groups may form salts in combination with lithium, sodium, potassium or ammonium ions.

n is 0 or an integer of 1 to 4, and is preferably 0, 1 or 2.

Of the compounds of the general formula (I), those compounds in which n is 0, and X is an alkyl group which may be substituted, or a phenyl group which may be substituted, and those compounds in which n is 1 or 2, and Y is a sulfonic acid group, a nitro group, a carboxylic acid group, a halogen atom (preferably a chlorine atom), an amino group which may be substituted, or a hydroxy group are especially preferred.

Typical examples of the compounds of the general formula (I) are shown below although the present invention is not limited thereto.

I - 1

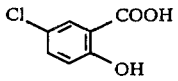

I - 2

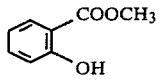

I - 3

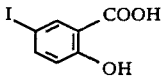

I - 4

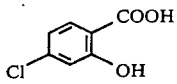

I - 5

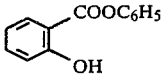

I - 6

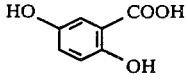

I - 7

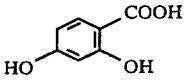

I - 8

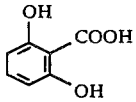

I - 9

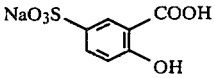

I - 10

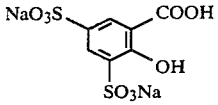

I - 11

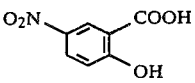

I - 12

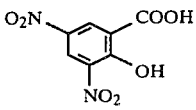

I - 13

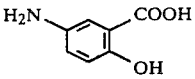

I - 14

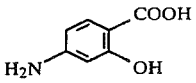

I - 15

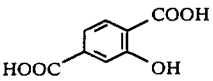

I - 16

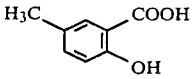

I - 17

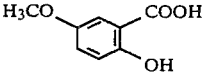

I - 18

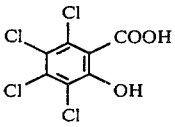

I - 19

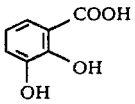

I - 20

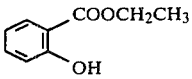

-continued

I - 21

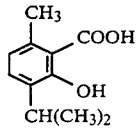

I - 22

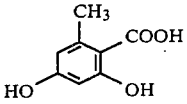

I - 23

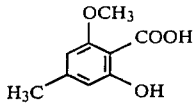

I - 24

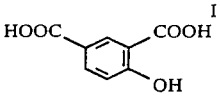

I - 25

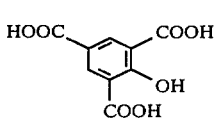

I - 26

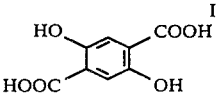

I - 27

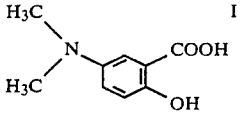

I - 28

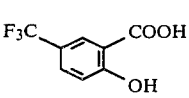

I - 29

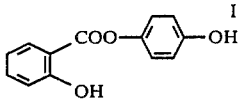

I - 30

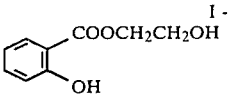

Especially preferred compounds of the general formula (I) are Compounds I-1, I-2, I-B 8, I-9, I-10, I-11, I-12, I-13, I-14 I-24, and I-25.

The amount of the compounds which can be employed is preferably from about 0.01 to about 10 g, more preferably from 0.05 to 5 g, per liter of the color developer.

The color developer which can be used in this invention can contain various types of color developing agents. An aromatic primary amine developing agent is widely used as a color developing agent. Preferred examples of color developers are p-phenylenediamine derivatives. Typical examples of p-phenylenediamine derivatives are shown below, although the present invention is not to be construed as being limited thereto.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-(β-hydroxyethyl)amino]aniline
D-5: 2-Methyl-4-[N-ethyl-N-(β-hydroxyethyl-)amino]aniline
D-6: N-Ethyl-N-(β-methanesulfonamidoethyl)-3-methyl-4-aminoaniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-p-ethoxyethylaniline
D-11: 4-Amino-3-methyl-N-ethyl-N-β-butoxyethylaniline These p-phenylenediamine derivatives may be used in the form of salts such as the sulfates, hydrochlorides, sulfites, and p-toluenesulfonates thereof. The abovedescribed compounds are described in, for example, U.S. Pat. Nos. 2,193,015, 2,552,241, 2,566,271, 2,592,364, 3,656,950, and 3,698,525. The amount of the aromatic primary amine developing agent is preferably from about 0.1 to about 20 g, more preferably from about 0.5 to about 10 g, per liter of the developer.

Although hydroxylamines can be used in the color developer in the free amine form, it is more usual for them to be used in the form of water-soluble acid salts. Typical acid salts include the sulfates, oxalates, chlorides, phosphates, carbonates, acetates, etc. The hydroxylamines used may be substituted or unsubstituted. In addition, the hydroxylamines may be substituted with an alkyl group at the nitrogen atom. Preferred hydroxylamines are those represented by the following formula (II):

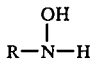

(II)

wherein R is a hydrogen atom or an alkyl group, preferably an alkyl group having from 1 to 3 carbon atoms, which may be substituted.

The foregoing hydroxylamines may be used in the form of water-soluble acid salts. Especially preferred hydroxylamines are those compounds in which R is a hydrogen atom. The amount of the hydroxylamine which can be employed is preferably from about 0.1 to about 20 g, more preferably from 1 to 10 g, per liter of the color developer.

Typical examples of the hydroxylamines which can be used in the present invention are shown below.

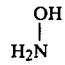

H - 1

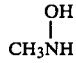

H - 2

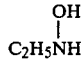

H - 3

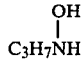

H - 4

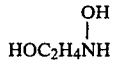

H - 5

The color developer as used herein can contain various organic or inorganic chelating agents.

Suitable inorganic chelating agents which can be used include sodium tetrapolyphosphate, sodium hexametaphosphate, etc. Organic chelating agents which can be used include organic carboxylic acids, aminopolycarboxylic acids, organic phosphonic acids, aminophosphonic acids, and organic phosphocarboxylic acids.

The organic carboxylic acids described above include acrylic acid, oxalic acid, maloic acid, succinic acid, glutaric acid, adipic acid, pimelic acid, cork acid, azelaic acid, sebacic acid, nonanedicarboxylic acid, decanedicarboxylic acid, undecanedicarboxylic acid, maleic acid, fumaric acid, citraconic acid, mesaconic acid, itaconic acid, malic acid, citric acid, tartaric acid, etc. It is to be noted that the present invention is not limited to the above-described compounds.

Exemplary aminopolycarboxylic acids include iminodiacetic acid, nitrilotriacetic acid, nitrilotripropionic acid, ethylenediaminetetraacetic acid, diethylenetriaminepentaacetic acid, triethylenetetraminehexaacetic acid, hydroxyethylethylenediaminetetraacetic acid, glycol ether diaminetetraacetic acid, hydroxyethyliminodiacetic acid, diaminopropanoltetraacetic acid, and 1,2-diaminopropanetetraacetic acid. In addition, the compounds described in, for example, Japanese Patent Application (OPI) Nos. 25632/77, 67747/80, 102624/82, and Japanese Patent Publication No. 40900/78 can be used.

Hydroxyalkylidenediphosphonic acid as described in U.S. Pat. Nos. 3,214,454, 3,794,591, and West German Patent (OLS) No. 2,227,639 and the compounds described in *Research Disclosure,* No. 18170 are well known as organic phosphonic acids and can be used.

Aminotri(methylenephosphonic acid), ethylenediamine-N,N,N',N'-tetramethylenephosphonic acid, and the like are well known as aminophosphonic acids. In addition, the compounds described in, for example, *Research Disclosure,* No. 18170, Japanese Patent Application (OPI) Nos. 208554/82, 61125/79, 29883/80 and 97347/81 can be used.

The compounds described in, for example, Japanese Patent Application (OPI) Nos. 102726/77, 42730/78, 121127/79, 4024/80, 4025/80, 126241/80, 65955/80, 65956/80, and *Research Disclosure,* No. 18170 can be use as organic phosphonocarboxylic acids.

These chelating agents can be used in the form of alkali metal salts or ammonium salts. They can be used alone or two or more of the chelating agents can be used in combination with each other.

The amount of the chelating agent employed is preferably from $1\times10^{-4}$ to $1\times10^{-1}$ mole, more preferably from $1\times10^{-3}$ to $1\times10^{-2}$ mole, per liter of the color developer.

Particularly preferred examples of chelating agents described above are organic phosphonic acids and aminophosphonic acids.

The pH of the color developer as used herein is preferably from about 9 to about 12, more preferably from 9 to 11. The color developer as used herein may also contain other known ingredients which are used in conventional color developers.

For example, as alkali agents and pH buffers, sodium hydroxide, potassium hydroxide, sodium carbonate, potassium carbonate, sodium triphosphate, potassium triphosphate, potassium metaborate, borax, and the like can be used alone or in combination with each other. In addition, for purposes of, e.g., imparting a buffer ability, and increasing the ionic strength, or for the convenience of preparation, disodium or dipotassium hydrogen phosphate, potassium or sodium dihydrogen phosphate, sodium or potassium hydrogen carbonate, boric acid, alkali metal nitrates, alkali metal sulfates, and the like can be used.

If desired, suitable development accelerators can be present in the color developer as used herein. For example, pyrimidium compounds and other cationic compounds, cationic dyes such as phenosafranine, and neutral salts such as thallium nitrate and potassium nitrate as described in U.S. Pat. No. 2,648,604, Japanese Patent Publication No. 9503/69, and U.S. Pat. No. 3,171,247; polyethylene glycol and its derivatives, and nonionic compounds such as polythioethers as described in Japanese Patent Publication No. 9304/69, U.S. Pat. Nos. 2,533,990, 2,531,832, 2,950,970, and 2,577,127; organic solvents as described in Japanese Patent Publication No. 9509/69 and Belgian Pat. No. 682,862; and organic amines, ethanolamine, ethylenediamine, and diethanolamine can be used. In addition, the accelerators described in L. F. A. Mason, *Photographic Processing Chemistry,* Focal Press Co., London (1966), pages 40–43 can be used. Furthermore, benzyl alcohol and phenylethyl alcohol described in U.S. Pat. No. 2,515,147, and pyridine, hydrazine, and amines described in *Nippon Shashin Gakkaishi,* (*Journal of the Society of Photographic Science and Technology of Japan*), Vol. 14, page 74 (1952) are useful accelerators. The thioether compounds described in U.S. Pat. No. 3,201,242 can also be used. Especially preferred are ethylenediamine, benzyl alcohol and thioether compounds.

Sodium sulfite, potassium sulfite, potassium hydrogen sulfite and sodium hydrogen sulfite which are usually used as preservatives, can be employed in the color developer as used herein.

If desired, suitable antifoggants can be added to the color developer as used herein. Suitable antifoggants which can be used include, inorganic antifoggants, e.g., alkali metal halides such as potassium bromide, sodium bromide and potassium iodide, and organic antifoggants, e.g., nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, and hydroxyazaindolidine, and mercapto substituted heterocyclic compounds, such as 1-phenyl-5-mercaptotetrazole, 2-mercaptobenzimidazole, and 2-mercaptobenzothiazole. In addition, mercapto substituted aromatic compounds such as thiosalicylic acid can be used. Especially preferred compounds are nitrogen-containing heterocyclic compounds. These antifoggants leach out of the light-sensitive material and accumulate in the color developer during the photographic processing.

Competitive couplers, foggants, and compensating developers can be added to the color developer for reversal color processing.

Useful competitive couplers include citrazinic acid, J acid and H acid. For example, the compounds described in U.S. Pat. No. 2,742,832, Japanese Patent Publication Nos. 9504/69, 9506/69, 9507/69, U.S. Pat. Nos. 3,520,690, 3,560,212, and 3,645,737 can be used in the color developer.

Alkali metal borohydrides, aminoborane, ethylenediamine, and the like can be used as foggants. In addition, the compounds described in Japanese Patent Publication No. 38816/72 can be used.

p-Aminophenol, N-benzyl-p-aminophenol, 1-phenyl-3-pyrazolidones, and the like can be used as compensating developers. For example the compounds described in Japanese Patent Publication Nos. 41475/70 and 19037/71 are useful.

In the practice of the present invention, the diffusion transfer color photographic process using the method described in U.S. Pat. Nos. 3,227,551 and 3,227,552 can be employed. In this case, the coupler may diffuse into another layer during the processing, or it may be necessary for the coupler to transfer.

The process of the present invention can be applied to the developing system (see, for example, U.S. Pat. Nos. 2,376,679, 2,322,027, and 2,801,171) in which color formers are incorporated in the light-sensitive material, and also to the developing system (see, for example, U.S. Pat. Nos. 2,252,718, 2,592,243, and 2,590,970) in which color formers are incorporated in the color developer.

Hence, the process of the present invention is applicable for the processing of any conventional color photographic silver halide light-sensitive material such as color negative films, color papers, color positive films, and color reversal films.

In the process of the present invention, color negative films, color positive films, color papers, and so forth which have been exposed imagewise are usually subjected to a treatment comprising basically the following steps:

(1) Color Development→Bleaching→Rinsing→Fixing→Rinsing→Stabilization→Drying;

(2) Color Development→Blixing→Rinsing→Stabilization→Drying; and (3) Color Development→Stop-Fixing→Blixing→Rinsing→Stabilization→Drying.

A prebath, a hardening bath, and so forth can be employed prior to the color development, and steps such as rinsing and stabilizing after the bleaching step may be omitted, if desired.

Color reversal films are usually subjected to a treatment comprising basically the following steps:

(4) Black and White Development→Stopping→Rinsing→Fogging→Color Development→Stopping→Rinsing→Bleaching→Rinsing→Fixing→Rinsing→Stabilization→Drying; and (5) Black and White Development→Rinsing→Fogging→Color development→Rinsing→Acceleration→Bleaching→Fixing→Rinsing→Stabilization→Drying.

In steps (4) and (5) above, a prebath, a pre-hardening bath, a neutralizing bath, etc., may also be employed. Also, a blixing bath may be used, if desired. Furthermore, the stopping bath, the stabilizing bath, the rinsing after the color development, the rinsing bath and the accelerating bath after the bleaching bath may be omitted. Foggants such as tertbutyl amine, borane, sodium borohydride, a tin/aminopolycarboxylic acid complex salt, and sodium borohydride can be used for the fogging bath. Alternately, the fogging bath can be omitted by adding the foregoing foggants to the color developing bath. Furthermore, the fogging bath can be replaced by a re-exposure, if desired.

Although the step sequences (1) to (5) described above are useful in the photographic processing of the present invention, the present invention is not to be construed as being limited thereto.

The color development of the present invention is usually carried out at a temperature of from about 20 to about 60° C. for a period of from 30 seconds to 10 minutes.

The color photographic silver halide light-sensitive materials which can be used in the present invention include any color photographic light-sensitive materials subjected to a color developing step, such as color negative films, color papers, color positive films, and color reversal films.

Photographic emulsions for use in the preparation of the light-sensitive materials to which the present invention is applicable can be prepared by the methods described in, for example, P. Glafkides, *Chimie et Physique Photographique,* published by Paul Montel Co. (1967), G. F. Duffin, *Photographic Emulsion Chemistry,* published by Focal Press Co. (1966), and V. L. Zelikman et al., *Making and Coating Photographic Emulsion,* published by the focal Press Co. (1964). That is, any of the acidic method, the neutral method, the ammonia method, and so forth can be employed. The single jet method, the double jet method, a combination thereof, and so forth can be used as the system in which soluble silver salts and soluble halides are reacted.

A method can be employed in which grains are formed in the presence of excess silver ions (the so-called back mixing method). The controlled double jet method in which the pAg in the liquid layer where silver halide is formed is maintained at a constant value can be used as one of the doublet jet methods.

Any of silver bromide, silver iodobromide, silver iodochlorobromide, silver chlorobromide and silver chloride can be used as the silver halide present in the photographic emulsion layers of the light-sensitive material to which the present invention is applicable.

In the course of formation of silver halide grains or physical ripening, cadmium salts, zinc salts, lead salts, thallium salts, iridium salts or iridium complex salts, rhodium salts or rhodium complex salts, iron salts or iron complex salts, and so forth may also be present.

The photographic emulsions as used herein may be subjected to spectral sensitization using methine dyes and so forth. Dyes which can be used for this purpose include cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes, and composite merocyanine dyes. These dyes may contain any of nuclei usually present as the basic heterocyclic nuclei in cyanine dyes.

Useful sensitizing dyes are, for example, the compounds described in German Pat. No. 929,080, U.S. Pat. Nos. 2,231,658, 2,493,748, 2,503,776, 2,519,001, 2,912,329, 3,656,959, 3,672,897, 3,694,217, 4,025,349, 4,046,572, British Pat. No. 1,242,588, Japanese Patent Publication Nos. 14030/69 and 24844/77.

These sensitizing dyes can be used alone or in combination with each other. Combinations of such sensitizing dyes are often used particularly for the purpose of super sensitization.

Dyes which do not have a spectral sensitization action by themselves, or substances which do not substantially absorb visible light but exhibit super sensitization may be incorporated into the emulsions in combination with the above sensitizing dyes. For example, aminostilbene compounds which are substituted with a nitrogen-containing heterocyclic group (e.g., the compounds described in U.S. Pat. Nos. 2,933,390 and 3,635,721), aromatic organic acid/formaldehyde condensates (e.g., the compounds described in U.S. Pat. No. 3,743,510), cadmium salts, azaindena compounds, and so forth can be employed. The combinations described in U.S. Pat. Nos. 3,615,613, 3,615,641, 3,617,295 and 3,635,721 are particularly useful.

Gelatin is advantageously used as a binder or protective colloid for the photographic emulsions. Other hydrophilic colloids can also be used, if desired.

For example, proteins such as gelatin derivatives, graft polymers of gelatin and other polymers, albumin, and casein; saccharide derivatives such as cellulose derivatives (e.g., hydroxyethyl cellulose, carboxymethyl cellulose, and cellulose sulfuric acid ester), sodium alginate, and starch derivatives; and a wide variety of hydrophilic synthetic polymers, homopolymers or copolymers, such as polyvinyl alcohol, polyvinyl alcohol partial acetal, poly(N-vinylpyrrolidone), polyacrylic acid, polymethacrylic acid, polyacrylamide, polyvinyl imidazole, and polyvinyl pyrazole can be employed.

Typical hydrophilic synthetic polymers which can be used are, for example, the compounds described in West German Patent Application (OLS) No. 2,312,708, U.S. Pat. Nos. 3,620,751, 3,879,205, and Japanese Patent Publication No. 7561/68.

The process of the present invention is applicable to multi-layer polychromatic photographic materials comprising a support having thereon at least two light-sensitive layers with different spectral sensitivities. Multi-layer natural color photographic materials usually have on the support at least one red-sensitive silver halide emulsion layer, at least one green-sensitive silver halide emulsion layer, and at least one blue-sensitive silver halide emulsion layer. The order in which the red-sensitive, green-sensitive and blue-sensitive emulsion layers are present on the support is not critical and can be determined appropriately. Usually a cyan-forming coupler is incorporated in the red-sensitive emulsion layer, a magenta-forming coupler, in the green-sensitive emulsion layer, and an yellow-forming coupler, in the blue-sensitive emulsion layer. In some cases, different combinations can be used.

The light-sensitive material to which the present invention is applicable may contain water-soluble dyes as filter dyes for various purposes of, e.g., prevention of irradiation, in the hydrophilic colloid layers. These water-soluble dyes include oxonol dyes, hemioxonol dyes, styryl dyes, merocyanine dyes, cyanine dyes, and azo dyes. Especially useful dyes are oxonol dyes, hemioxonol dyes, and merocyanine dyes.

In the practice of the present invention, known anti-fading agents as described below can be used in combination. Color image stabilizer can be used alone or in combination with each other.

Known anti-fading agents which can be employed include the hydroquinone derivatives described in U.S. Pat. Nos. 2,360,290, 2,418,613, 2,675,314, 2,701,197, 2,704,713, 2,728,659, 2,732,300, 2,735,765, 2,710,801, 2,816,028, and British Pat. No. 1,363,921, the gallic acid derivatives described in U.S. Pat. Nos. 3,457,079 and 3,069,262, the p-alkoxyphenols described in U.S. Pat. Nos. 2,735,765, 3,698,909, Japanese Patent Publication Nos. 20977/74 and 6623/77, the p-oxyphenol derivatives described in U.S. Pat. Nos. 3,432,300, 3,573,050, 3,574,627, 3,764,337, Japanese Patent Application (OPI) Nos. 35633/77, 147434/77, and 152225/77, and the bisphenols described in U.S. Pat. No. 3,700,455.

The light-sensitive material to which the present invention is applicable may contain ultraviolet absorbers in the hydrophilic colloid layers thereof. Ultraviolet absorbers which can be used include benzotriazole compounds substituted with an aryl group (e.g., the compounds described in U.S. Pat. No. 3,533,794), 4-thiazolidone compounds (e.g., the compounds described in U.S. Pat. Nos. 3,314,794 and 3,352,681), benzophenone compounds (e.g., the compounds described in Japanese Patent Application (OPI) No. 2784/71), cinnamic acid esters (e.g., the compound described in U.S. Pat. Nos. 3,705,805 and 3,707,375), butadiene compounds (e.g., the compounds described in U.S. Pat. No. 4,045,229), and benzoxyzole compounds (e.g., the compounds described in U.S. Pat. No. 3,700,455). In addition, the compounds described in U.S. Pat. No. 3,499,762 and Japanese Patent Application (OPI) No. 48535/79 can be used.

Ultraviolet absorbing couplers (e.g., α-naphthol-based cyan dye-forming couplers), ultraviolet absorbing polymers, and so forth may also be present. These ultraviolet absorbers may be mordanted to a specific layer of the photographic material, if desired.

The photographic emulsion layers and other hydrophilic colloid layers of the light-sensitive material to which the present invention is applicable also may contain brighteners such as stilbene, triazine, oxazole, and cumarine brighteners. These brighteners may be water-soluble, or water-insoluble brighteners may be used in the form of dispersions. Typical examples of fluorescent brighteners are described in, for example, U.S. Pat. Nos. 2,632,701, 3,269,840, 3,359,102, British Pat. Nos. 852,075, and 1,319,763.

The photographic emulsion layers of the light-sensitive material to which the present invention is applicable may contain couplers capable of forming a color on oxidative coupling with aromatic primary amine developing agents (e.g., phenylenediamine derivatives and aminophenol derivatives) in the color developing processing.

Typical magenta couplers which are suitable are described in, for example, U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Pat. No. 1,810,464, West German Patent Application (OLS) Nos. 2,408,665, 2,417,945, 2,418,959, 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, 55122/78, and Japanese Patent Application No. 110943/80.

Benzoylacetoanilide and pivaroylacetoanilide compounds can be advantageously used as yellow couplers. Typical examples of yellow couplers which can be employed are described in, for example, U.S. Pat. Nos. 2,875,057, 3,265,506, 3,408,194, 3,551,155, 3,582,322, 3,725,072, 3,891,445, West German Pat. No. 1,547,868, West German Patent Application Laid-Open Nos. 2,219,917, 2,261,361, 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21826/76, 87650/75, 82424/77, and 115219/77.

Phenol and naphthol compounds can be used as cyan couplers. Typical cyan couplers are described in, for example, U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West German Patent Application (OLS) Nos. 2,414,830, 2,454,329, Japanese Patent Application (OPI) Nos. 59838/73, 26034/76, 5055/73, 146828/76, 69624/77, 90932/77, 155538/82, and 20454/82.

The compounds described in, for example, U.S. Pat. Nos. 3,476,560, 2,521,908, 3,034,892, Japanese Patent Publication Nos. 2016/69, 22335/63, 11304/67, 32461/69, Japanese Patent Application (OPI) Nos. 26034/76, 42121/77, and West German Patent Application (OLS) No. 2,418,959 can be used as colored couplers.

The compounds described in, for example, U.S. Pat. Nos. 3,227,554, 3,617,291, 3,701,783, 3,790,384, 3,632,345, West German Patent Application (OLS) Nos. 2,414,006, 2,454,301, 2,454,329, British Pat. No. 953,454, Japanese Patent Application (OPI) Nos. 69624/77, 12335/74, and Japanese Patent Publication No. 16141/76 can be used as development inhibitor releasing DIR couplers.

Compounds releasing development inhibitors as the development progresses may be present in the light-sensitive material in addition to DIR couplers. For example, the compounds described in U.S. Pat. Nos. 3,297,445, 3,379,529, West German Patent Application (OLS) No. 2,417,914, Japanese Patent Application (OPI) Nos. 15271/77 and 91116/78 can be used.

Two or more of the above-described couplers can be present in the same layer, if desired, or the same coupler can be incorporated in two or more layers, if desired.

The amount of the couplers employed is generally from $2\times10^{-3}$ to $5\times10^{-1}$ mole per mole of silver in the emulsion and preferably from $1\times10^{-2}$ to $5\times10^{-1}$ mole per mole of silver in the emulsion.

The present invention is described in greater detail with reference to the following examples. Unless otherwise indicated, all parts, percents, ratios and the like are by weight.

EXAMPLE 1

A color developer of the following composition was prepared.

| | |
|---|---|
| Distilled Water | 700 ml |
| Sodium Sulfite (anhydrous) | 7.5 g |
| Sodium Triphosphate (dodecahydrate) | 40 g |
| Sodium Bromide | 0.9 g |
| Potassium Iodide (0.1% aq. soln.) | 90.0 ml |
| Sodium Hydroxide | 3.0 g |
| 4-Amino-N—ethyl-N—(β-methanesulfonamidoethyl)-3-methyl-4-aminoaniline | 11.0 g |
| Additive (as shown in Table 1) | 1,000 ml |
| Distilled Water to make (pH = 11.65) | |

To this color developer was added 1 ppm as $Fe^{+++}$ ion of a $FeCl_3$ aqueous solution. The color developer was then allowed to stand at 40° C. for 14 days.

Then the concentration of the color developing agent was measured using the sensitometric method, and the results obtained are shown in Table 1 below.

TABLE 1

| Run No. | Additive ($3\times10^{-3}$ mol/l) | Color Developing Agent (g/l) | Remarks |
|---|---|---|---|
| 1 | — | 6.7 | Control |
| 2 | Glucosamine Hydrochloride* | 9.0 | Comparative example |
| 3 | Dihydroxyamine** | 8.3 | Comparative example |
| 4 | I-1 | 10.2 | Present Invention |
| 5 | I-8 | 10.6 | Present Invention |
| 6 | I-9 | 10.5 | Present Invention |
| 7 | I-11 | 10.3 | Present Invention |
| 8 | I-12 | 10.7 | Present Invention |

Note:
*Compound disclosed in Japanese Patent Application (OPI) No. 57148/77
**Compound disclosed in British Patent 1,306,176

As apparent from the results in Table 1, deterioration of color developing agents is greatly inhibited by addition of the additives of the present invention to the color developer.

EXAMPLE 2

A color developer of the following composition was prepared.

| | |
|---|---|
| Distilled Water | 800 ml |
| Benzyl Alcohol | 14 ml |
| Diethylene Glycol | 10 ml |
| Sodium Sulfite | 2 g |
| Potassium Bromide | 0.5 g |
| Sodium Carbonate | 30 g |
| N—Ethyl-N—(β-methanesulfonamidoethyl)-3-methyl-4-aminoaniline sulfonate | 5 g |
| Hydroxylamine Sulfate (not present in Run No. 1) | 4.0 g |
| Additive (as shown in Table 2 below) | 1,000 ml |
| Distilled water to make (pH = 10.00) | |

To this color developer was added 1 ppm as $Fe^{+++}$ ion of a $FeCl_3$ aqueous solution. The color developer was then allowed to stand at 40° C. for 20 days. Then the concentrations of hydroxylamine and the color developing agents were measured. The results obtained are shown in Table 2 below.

TABLE 2

| Run No. | Additive ($3 \times 10^{-3}$ mol/l) | Hydroxylamine Sulfate (g/l) | Color Developing Agent (g/l) | Remarks |
|---|---|---|---|---|
| 1 | (no hydroxylamine) | — | 1.0 | Control |
| 2 | — | 0.5 | 3.6 | " |
| 3 | Triethanolamine* | 2.5 | 4.2 | Comparative example |
| 4 | Polyethyleneimine** | 2.3 | 4.2 | Comparative example |
| 5 | Tiron*** | 2.1 | 4.2 | Comparative example |
| 6 | I-1 | 3.0 | 4.6 | Present Invention |
| 7 | I-2 | 3.2 | 4.6 | Present Invention |
| 8 | I-8 | 3.4 | 4.7 | Present Invention |
| 9 | I-9 | 3.3 | 4.7 | Present Invention |
| 10 | I-10 | 3.7 | 4.8 | Present Invention |
| 11 | I-11 | 3.4 | 4.7 | Present Invention |
| 12 | I-12 | 3.8 | 4.8 | Present Invention |
| 13 | I-13 | 3.3 | 4.7 | Present Invention |
| 14 | I-14 | 3.3 | 4.7 | Present Invention |
| 15 | I-24 | 3.2 | 4.6 | Present Invention |

Note:
*Compound disclosed in U.S. Pat. No. 4,170,478
**Compound disclosed in U.S. Pat. No. 4,252,892
***Compound disclosed in Japanese Patent Application (OPI) No. 47038/81 1,2-dihydroxybenzen-3,5-disulfonic acid di-sodium salt (trade name, made by Dojin Kagaku K.K.)

As is apparent from the results in Table 2 above, deterioration of the color developing agents is greatly prevented by the presence of hydroxylamine, but when the additives of the present invention are also present, the effect is increased to a much greater extent and the deterioration of hydroxylamine is markedly prevented.

EXAMPLE 3

A multi-layer color light-sensitive material was prepared by coating a first layer (lowermost layer) to a sixth layer (uppermost layer) as described below on a paper support, both sides of which was coated with polyethylene.

| | |
|---|---|
| Sixth Layer (Protective Layer) | |
| Gelatin | 1,500 mg/m² |
| Fifth Layer (Red-Sensitive Layer) | |
| Silver Chlorobromide Emulsion (silver bromide: 50 mol %) | 250 mg/m² (calculated as silver) |
| Gelatin | 1,500 mg/m² |
| Cyan Coupler (*1) | 500 mg/m² |
| Coupler Solvent (*2) | 250 mg/m² |
| Fourth Layer | |
| Gelatin | 1,200 mg/m² |
| Ultraviolet Absorber (*3) | 700 mg/m² |
| Ultraviolet Absorber Solvent (*2) | 250 mg/m² |
| Third Layer (Green-Sensitive Layer) | |
| Silver Chlorobromide Emulsion (silver bromide: 70 mol %) | 350 mg/m² (calculated as silver) |
| Gelatin | 1,500 mg/m² |
| Magenta Coupler (*4) | 400 mg/m² |
| Coupler Solvent (*5) | 400 mg/m² |
| Second Layer (Intermediate Layer) | |
| Gelatin | 1,000 mg/m² |
| First Layer (Blue-Sensitive Layer) | |
| Silver Chlorobromide (silver bromide: 80 mol %) | 350 mg/m² (calculated as silver) |
| Gelatin | 1,500 mg/m² |
| Yellow Coupler (*6) | 500 mg/m² |
| Coupler Solvent (*2) | 500 mg/m² |
| Support | |
| Polyethylene-laminated paper (the polyethylene layer in contact with the first layer contained a white pigment (i.e., $TiO_2$) and bluish dye (i.e., ultramarine).) | |

(*1) Cyan Coupler: 2-[α-(2,4-Di-tert-amylphenoxy)butan-amido]-4,6-dichloro-5-methylphenol
(*2) Solvent: Trinonyl phosphate
(*3) Ultraviolet Absorber: 2-(2-Hydroxy-3-sec-butyl-5-tert-butylphenyl)benzotriazole
(*4) Magenta Coupler: 1-(2,4,6-Trichlorophenyl)-3-[2-chloro-5-tetradecanamido]anilino-2-pyrazolino-5-one
(*5) Coupler Solvent: o-Cresyl phosphate
(*6) Yellow Coupler: α-Pivaloyl-α-(2,4-dioxo-5,5-dimethyloxozolidine-3-yl)-2-chloro-5-[α-(2,4-di-tert-amylphenoxy)butan-amido]acetoanilide The light-sensitive material prepared as described above was exposed to light through an optical wedge and then processed as follows:

| | Temperature (°C.) | Time (min) |
|---|---|---|
| Color Development | 33 | 3.5 |
| Blixing | " | 1.5 |
| Rinsing | " | 3 |
| Drying | " | 10 |

The composition of the processing solutions used in each step is described below:

Color Developer

Color developers used in Run Nos. 2 to 15 of Example 2, just after the preparation thereof or after storage at 40° C. for 20 days.

| Blixing Solution | |
|---|---|
| Ammonium Thiosulfate | 124.5 g |
| Sodium Metahydrogensulfite | 13.3 g |
| Sodium Sulfite (Anhydrous) | 2.7 g |
| EDTA Iron (III) Ammonium Salt | 65 g |
| Water to make | 1,000 ml |

-continued

| Blixing Solution |
|---|
| (pH = 6.7–6.8) |

The yellow, magenta and cyan reflection density was measured using a Fuji-type automatic densitometer (manufactured by Fuji Photo Film Co., Ltd.).

Using the photographic properties of the light-sensitive material processed with the color developer just after the preparation of the color developer as standards, changes in the photographic properties when the color developer was used after storage for a predetermined period of time; that is, changes in density at Dmin and D=2.0 were examined. The results obtained are shown in Table 3 below.

TABLE 3

| | Changes in Photographic Properties (ΔDmin) | | | Changes in Photographic Properties (ΔD = 2.0) | | |
|---|---|---|---|---|---|---|
| Run No. | R | G | B | R | G | B |
| Comparative Example | | | | | | |
| 2 | +0.06 | +0.03 | +0.03 | +0.32 | +0.21 | +0.30 |
| 3 | +0.02 | +0.01 | +0.02 | +0.08 | +0.04 | +0.06 |
| 4 | +0.02 | +0.02 | +0.02 | +0.08 | +0.04 | +0.06 |
| 5 | +0.02 | +0.01 | +0.02 | +0.10 | +0.05 | +0.08 |
| Present Invention | | | | | | |
| 6 | 0 | 0 | 0 | +0.04 | +0.03 | +0.04 |
| 7 | 0 | 0 | 0 | +0.03 | +0.02 | +0.03 |
| 8 | 0 | 0 | 0 | +0.01 | 0 | +0.01 |
| 9 | 0 | 0 | 0 | +0.02 | +0.01 | +0.02 |
| 10 | 0 | 0 | 0 | 0 | 0 | +0.01 |
| 11 | 0 | 0 | 0 | +0.01 | +0.01 | +0.01 |
| 12 | 0 | 0 | 0 | 0 | 0 | +0.01 |
| 13 | 0 | 0 | 0 | +0.02 | +0.01 | +0.01 |
| 14 | 0 | 0 | 0 | +0.02 | +0.01 | +0.02 |
| 15 | 0 | 0 | 0 | +0.03 | +0.01 | +0.02 |

As is apparent from the results in Table 3, when the process of the present invention is employed, the changes in photographic properties are markedly reduced (in particular, the changes at D=2.0 are greatly reduced); that is, the stability with time of the color developer is greatly increased.

EXAMPLE 4

A color developer with the following composition was prepared.

| | |
|---|---|
| Distilled Water | 800 ml |
| Chelating Agent (as shown in Table 4 below) | |
| Benzyl Alcohol | 14 ml |
| Diethylene Glycol | 10 ml |
| Sodium Sulfite | 2 g |
| Potassium Bromide | 0.5 g |
| Sodium Carbonate | 30 g |
| N—Ethyl-N—(β-methanesulfonamidoethyl)-3-methyl-4-aminoaniline sulfonate | 5.0 g |
| Hydroxyamine Sulfate | 4.0 g |
| Compound of the Present Invention (as shown in Table 4 below) | |
| Distilled Water to make (pH = 10.00) | 1,000 ml |

To this color developer was added 1 ppm as $Fe^{+++}$ ion of a $FeCl_3$ aqueous solution and 200 ppm of a $Ca(NO_3)_2$ solution as $Ca^{++}$, and the color developer was then stored at 40° C. for 20 days.

Then the concentrations of hydroxylamine and the color developing agent were measured, and whether or not precipitation occurred was evaluated. The results obtained are shown in Table 4 below.

TABLE 4

| Run No. | Chelating Agent ($4 \times 10^{-3}$ mol/l) | Compound of the Invention ($3 \times 10^{-3}$ mol/l) | Hydroxylamine Sulfate (g/l) | Color Developing Agent (g/l) | Precipitation |
|---|---|---|---|---|---|
| 1 | — | — | 0.6 | 3.6 | Occurred |
| 2 | A | — | 1.5 | 4.1 | None |
| 3 | B | — | 2.9 | 4.3 | Occurred |
| 4 | C | — | 2.5 | 4.1 | None |
| 5 | A | I-9 | 3.2 | 4.6 | " |
| 6 | B | " | 3.4 | 4.6 | " |
| 7 | C | " | 3.4 | 4.6 | " |
| 8 | A | I-10 | 3.3 | 4.6 | " |
| 9 | B | " | 3.8 | 4.8 | " |
| 10 | C | " | 3.7 | 4.7 | " |
| 11 | A | I-11 | 3.2 | 4.6 | " |
| 12 | B | " | 3.4 | 4.6 | " |
| 13 | C | " | 3.4 | 4.6 | " |
| 14 | A | I-12 | 3.4 | 4.6 | " |
| 15 | B | " | 3.8 | 4.8 | " |
| 16 | C | " | 3.8 | 4.8 | " |

A;

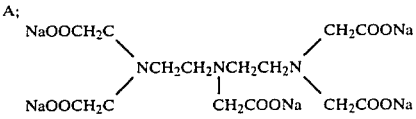

B; $H_2O_3P-C(CH_3)(OH)-PO_3H_2$

C;

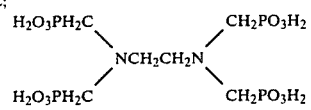

As is apparent from the results in Table 4 above, when the compounds of the present invention are used in combination with the chelating agents, deterioration of hydroxylamine and the color developing agents can be greatly reduced without precipitation occurring even in the presence of calcium ions. If B or C is used as the chelating agent to be used in combination, the deterioration of hydroxylamine and the color developing agents can be much more prevented.

While the invention has been described in detail and with reference to specific embodiments thereof, it will be apparent to one skilled in the art that various changes and modifications can be made therein without departing from the spirit and scope thereof.

What is claimed is:

1. A process for processing an imagewise exposed color photographic silver halide light-sensitive material comprising processing the color photographic silver halide light-sensitive material with a color developer containing at least one compound represented by the general formula (I):

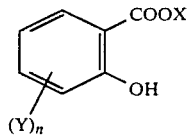

(I)

wherein X is a hydrogen atom, an alkali metal atom, an ammonium group, an alkyl group, or an aryl group; Y is a substituent on the phenyl group and is a halogen atom, an alkyl group, an alkoxy group, an amino group, a hydroxyl group, a nitro group, a sulfonic acid group or a carboxylic group, a nitro group, a sulfonic acid group or a carboxylic acid group; and n is 0, 1, 2, 3 or 4; and said color developer additionally contains a hydroxylamine.

2. The process of claim 1, wherein said alkali metal atom for X is a sodium atom, a potassium atom or a lithium atom, said alkyl group for X is an alkyl group having 1 to 10 carbon atoms, said aryl group for X is a phenyl group or a naphthyl group, said alkyl group and said aryl group for X may be substituted with one or more of a halogen atom, a hydroxy group, an alkoxy group having 1 to 4 carbon atoms, a sulfonic acid group, carboxylic acid group, an aldehyde group, a nitro group, and an amino group as substituents; said halogen atom for Y is a fluorine atom, a bromine atom, a chlorine atom or an iodine atom, said alkyl group and said alkoxy group for Y each has from 1 to 10 carbon atoms, said alkyl group and said alkoxy group for Y may be substituted with one or more of a halogen atom, a hydroxy group, a sulfonic acid group and a carboxylic acid group as substituents, and said amino group for Y may be substituted by one or more lower alkyl groups, and said sulfonic acid group and said carboxylic acid group for Y may be in the form of the lithium, sodium, potassium or ammonium salt thereof.

3. The process of claim 1, wherein n is 0, X is an unsubstituted or substituted alkyl group or an unsubstituted or substituted phenyl group or n is one or two, and Y is a sulfonic acid group, a nitro group, a carboxylic acid group, a halogen atom, an unsubstituted or substituted amino group or a hydroxy group.

4. The process of claim 1, wherein said color developer contains an aromatic primary amine developing agent.

5. The process of claim 4, wherein said aromatic primary amine developing agent is a p-phenylenediamine derivative.

6. The process of claim 5, wherein said aromatic primary amine developing agent is present in said color developer in an amount of from about 0.01 to about 20 g, per liter of the color developer.

7. The process of claim 1, wherein said hydroxylamine is represented by the general formula (II)

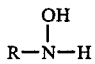

(II)

wherein R is a halogen atom or an unsubstituted or substituted alkyl group.

8. The process of claim 7, wherein said hydroxylamine is present in said color developer in an amount of from about 0.1 to about 20 g, per liter of the color developer.

9. The process of claim 1, wherein said compound represented by the general formula (I) is present in the color developer in an amount of from about 0.01 to about 10 g, per liter of the color developer.

10. The process of claim 1, wherein said color photographic silver halide light-sensitive material contains a dye-forming couple.

11. The process of claim 1, wherein said hydroxylamine is contained in the form of water-soluble acids selected from the group consisting of sulfates, oxalates, chlorides, phosphates, carbonates and acetates.

12. A color developer comprising an aromatic primary amine developing agent forming a dye on coupling with a color coupler and containing at least one compound represented by the general formula (I)

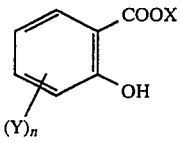

(I)

wherein X is a hydrogen atom, an alkali metal atom, an ammonium group, an alkyl group or an aryl group; Y is a substituent on the phenyl group and is a halogen atom, an alkyl group, an alkoxy group, an amino group, a hydroxy group, a nitro group, a sulfonic acid group or a carboxylic acid group; and n is 0 or an integer of 1 to 4 and said color developer additionally contains a hydroxylamine.

13. The color developer of claim 12, wherein said alkali metal atom for X is a sodium atom, a potassium atom or a lithium atom, said alkyl group for X is an alkyl group having 1 to 10 carbon atoms, said aryl group for X is a phenyl group or a naphthyl group, said alkyl group and said aryl group for X may be substituted with one or more of a halogen atom, a hydroxy group, an alkoxy group having 1 to 4 carbon atoms, a sulfonic acid group, a carboxylic acid group, an aldehyde group, a nitro group, and an amino group as substituents; said halogen atom for Y is a fluorine atom, a bromine atom, a chlorine atom or an iodine atom, said alkyl group and said alkoxy group for Y each has from 1 to 10 carbon atoms, said alkyl group and said alkoxy group for Y may be substituted with one or more of a halogen atom, a hydroxy group, a sulfonic acid group and a carboxylic acid group as substituents, and said amino group for Y may be substituted by one or more lower alkyl groups, and said sulfonic acid group and said carboxylic acid group for Y may be in the form of the lithium, sodium, potassium or ammonium salt thereof.

14. The color developer of claim 12, wherein n is 0, X is an unsubstituted or substituted alkyl group or an unsubstituted or substituted phenyl group or n is one or two, and Y is a sulfonic acid group, a nitro group, a carboxylic acid group, a halogen atom, an unsubstituted or substituted amino group or a hydroxy group.

15. The color developer of claim 12, wherein said aromatic primary amine developing agent is a p-phenylenediamine derivative.

16. The color developer of claim 15, wherein said aromatic primary amine developing agent is present in said color developer in an amount of from about 0.01 to about 20 g, per liter of the color developer.

17. The color developer of claim 12, wherein said hydroxylamine is represented by the general formula (II)

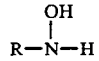

(II)

wherein R is a halogen atom or an unsubstituted or substituted alkyl group.

18. The color developer of claim 17, wherein said hydroxylamine is present in said color developer in an amount of from about 0.1 to about 20 g, per liter of the color developer.

19. The color developer of claim 12, wherein said compound represented by the general formula (I) is present in the color developer in an amount of from about 0.01 to about 10 g, per liter of the color developer.

20. The color developer of claim 12, wherein said hydroxyl amine is contained in the form of water-soluble acids selected from the group consisting of sulfates, oxalates, chlorides, phosphates, carbonates and acetates.

* * * * *